US005746785A

United States Patent [19]

Moulton et al.

[11] Patent Number: 5,746,785

[45] Date of Patent: May 5, 1998

[54] DIESEL FUEL HAVING IMPROVED QUALITIES AND METHOD OF FORMING

[75] Inventors: David S. Moulton, Hondo; David W. Naegeli, San Antonio, both of Tex.

[73] Assignee: Southwest Research Institute, San Antonio, Tex.

[21] Appl. No.: 888,991

[22] Filed: Jul. 7, 1997

[51] Int. Cl.[6] ..... C10L 1/18

[52] U.S. Cl. ..... 44/443; 44/444

[58] Field of Search ..... 44/443, 444

[56] References Cited

U.S. PATENT DOCUMENTS

| | | | |
|---|---|---|---|
| 2,786,745 | 3/1957 | Stayner et al. | 52/0.5 |
| 2,838,571 | 6/1958 | Filbey | 260/611 |
| 2,930,681 | 3/1960 | Barusch | 44/74 |
| 3,594,136 | 7/1971 | Rosen | 44/443 |
| 4,053,428 | 10/1977 | Pindar et al. | 252/52 A |
| 4,273,891 | 6/1981 | Pindar et al. | 525/145 |
| 4,464,182 | 8/1984 | Jack | 44/443 |
| 4,758,363 | 7/1988 | Sung et al. | 252/51.5 R |
| 4,877,416 | 10/1989 | Campbell | 44/443 |
| 5,024,678 | 6/1991 | Mertens-Gottselig et al. | 44/348 |
| 5,360,460 | 11/1994 | Mozdzen et al. | 44/443 |

*Primary Examiner*—Jacqueline V. Howard
*Attorney, Agent, or Firm*—Jenkens & Gilchrist

[57] ABSTRACT

A mixture of alkoxy-terminated poly-oxymethylenes, having a varied mixture of molecular weights, is blended with diesel fuel to form an improved fuel for autoignition engines. The mixed alkoxy-terminated poly-oxymethylenes may be produced by reacting paraformaldehyde with methylal, methanol, or other alcohol for a length of time and at a temperature and pressure sufficient to form the mixed alkoxy-terminated poly-oxymethylenes. The base diesel fuel, when blended with the mixed alkoxy-terminated poly-oxymethylenes in a volume ratio of from about 2 to about 5 parts diesel fuel to 1 part mixed alkoxy-terminated poly-oxymethylenes, provides a higher quality fuel having significantly improved lubricity and reduced smoke formation, without degradation of the cetane number or smoke formation characteristics when compared with the base diesel fuel.

9 Claims, No Drawings

DIESEL FUEL HAVING IMPROVED QUALITIES AND METHOD OF FORMING

GOVERNMENT LICENSE RIGHTS

The U.S. Government has a paid-up license in this invention and the right in limited circumstances to require the patent owner to license others on reasonable terms as provided for by the terms of Contract No. EPA 68-W9-0077 awarded by the Environmental Protection Agency.

BACKGROUND OF THE INVENTION

1. Technical Field

This invention relates generally to an improved diesel fuel and a method of forming the improved fuel, and more particularly to a fuel having improved lubricity without compromising the autoignition and smoke generation properties of the fuel, and to a method for producing such a fuel.

2. Background Art

The combustion of conventional diesel fuel in engines produces smoke in the exhaust. Oxygenated compounds, and compounds containing few or no carbon-to-carbon chemical bonds, such as methanol, are known to reduce smoke and engine exhaust emissions. However, most such compounds are nearly insoluble in diesel fuel, and they have poor ignition quality, as indicated by their cetane numbers. Furthermore, other methods of improving diesel fuels by chemical hydrogenation to reduce their sulfur and aromatics contents, also causes a reduction in fuel lubricity. Diesel fuels of low lubricity may cause excessive wear of fuel injectors and other moving parts which come in contact with the fuel.

This invention is directed to overcoming the problems set forth above. It is desirable to have a high quality diesel fuel, and a method of producing such a fuel, that has better fuel lubricity than conventional low-sulfur, low-aromatics diesel fuels, and comparable ignition quality and smoke generation characteristics. It is also desirable to have such a fuel and a method of producing the fuel which contains an additional blended component that is soluble in diesel fuel and has no carbon-to-carbon bonds. Furthermore, it is desirable to have such a fuel wherein the concentration of gums and other undesirable products is reduced.

SUMMARY OF THE INVENTION

In accordance with one aspect of the present invention, a method for forming an improved diesel fuel includes providing a mixture of alkoxy-terminated poly-oxymethylenes and mixing the alkoxy-terminated poly-oxymethylenes with diesel fuel in a ratio of, by volume, 1 part mixed alkoxy-terminated poly-oxymethylenes with from about 2 to about 5 parts diesel fuel. The mixture is then separated into a first phase containing diesel fuel and the alkoxy-terminated poly-oxymethylenes and a second phase containing insoluble reaction products made with the alkoxy-terminated poly-oxymethylenes and gums extracted from the diesel fuel.

Other features of the method for forming an improved diesel fuel, in accordance with the present invention, includes reacting about 1 part methanol with about 3 parts paraformaldehyde in a closed system for a period of time, and at a temperature and pressure sufficient to produce a mixture of methoxy-terminated poly-oxymethylenes, an example of alkoxy-terminated poly-oxymethylenes, having a molecular weight of from about 80 to about 350. Alternatively, the mixture of methoxy-terminated poly-oxymethylenes may be formed by reacting about 1 part methylal with about 5 parts paraformaldehyde in a closed system for a period of time, and at a temperature and pressure sufficient to produce a mixture of methoxy- terminated poly-oxymethylenes having a molecular weight of from about 80 to about 350.

In accordance with another aspect of the present invention, a fuel for auto-ignition engines comprises from abou t 70% to about 95% diesel fuel and from about 5% to about 30% mixed alkoxy-terminated poly-oxymethylenes.

Other features of the fuel for auto-ignition engines, embodying the present invention, includes the fuel having a lubricity property, as indicated by the diameter of a wear scar measured by methods set forth under ASTM D 5001 using a ball-on-cylinder lubrication evaluator, of less than 0.55 mm.

DETAILED DESCRIPTION OF THE INVENTION

The present invention includes an improved fuel for compression ignition engines, i.e., an improved diesel fuel, and a method for producing the fuel. The first step in the method for forming the fuel is the production of mixed molecular weight alkoxy-terminated poly-oxymethylenes (ATPOM), collectively represented by chemical formula $C_nH_{2n+1}O(CH_2O)_xC_nH_{2n+1}$, which have a range of molecular weights, preferably from about 80 to about 350. Both x and n in the chemical formula represent integers equal to 1 or greater. While various procedures may be followed for the production of the mixed ATPOMs, two methods undertaken by the inventors of the present invention to form the improved diesel fuel are described below as examples.

In the first example, methanol and paraformaldehyde are reacted in a closed system at elevated temperatures and pressures. More specifically, a 1.6 liter cylindrical reactor was loaded with a mixture of methanol and paraformaldehyde, in amolar ratio of about 1 mole methanol to 3 moles paraformaldehyde. The cylindrical reactor was sealed and heated and maintained under pressure for a time sufficient to produce a mixture of alkyoxy-terminated poly-oxymethylenes in which the alkoxy-portion was a methyoxy- group. More specifically, the mixture contained methoxy-terminated poly-oxymethylenes having a molecular weight of from about 80 to about 350. Desirably, the reactor is maintained at a temperature of from about 150° C. to about 240° C. and at a pressure of from about 300 psig to about 1,000 psig. The required reaction time is typically from about 4 to about 7 hours under the above temperature and pressure conditions.

In a second illustration of a procedure for producing mixed ATPOMs with a range of molecular weights, methylal (dimethoxymethane) and paraformaldehyde were combined in a molar ratio of about 1 mole methylal to about 5 moles paraformaldehyde, and reacted in a closed system at elevated temperatures and pressures. In this procedure, a small amount of formic acid, about 0.1 % by weight of the total reactants, was added as a catalyst. The same temperatures, pressures and reaction times are maintained as in the first example. Methoxy-terminated poly-oxymethylenes (MTPOM), a specific example of ATPOM, produced by both of the above processes had a range of predicted mole weights, based on a gas chromatography analysis of measurements provided by a mass spectrometer of from 80.7 to 329.0.

The ATPOM mixture produced by either of the above two described procedures, or by another procedure, is then mixed with a commercial diesel fuel in a ratio of about 1 part alkoxy-terminated poly-oxymethylenes with from about 2 to about 5 parts diesel fuel. In an illustrative example of the actual fuel produced, about 1 part mixed methoxy-terminated poly-oxymethylenes was added to 3 parts diesel fuel. If desired, the ATPOM mixture may be separated from other reaction products formed during the formation of the mixture by extracting the ATPOMs with a hydrocarbon solvent, such as pentane, cyclohexane, petroleum naphtha, or a distillate fuel. In the present illustrative example, the reaction products of the MTPOM mixture were not separated prior to mixing with the diesel fuel.

In forming the diesel fuel having improved quality, the total reaction product (mixed MTPOMs plus other products of reaction), were mixed with a low sulfur (0.02%) DF-2 diesel fuel. When left undisturbed for a few minutes, the mixture separated into two phases. The first, or lighter phase, contained the diesel fuel base stock blended with the MTPOM component, and measured about 81% of the original mixture. The remaining second, or heavier phase comprising about 19% of the original mixture, contained the other reaction products of the MTPOM mixture and gums extracted from the diesel fuel base stock.

The chemical methylal is the monomeric form of a methoxy-terminated poly-oxymethylene polymer $CH_3O(CH_2O)_xCH_3$, wherein x equals 1. The higher molecular weight polymers described herein as mixed methyoxy-terminated poly-oxymethylenes (MTPOMs) desirably have molecular weights ranging from about 80 to about 350. Although methylal can be used alone to provide some of the benefits of improved diesel fuel described and claimed herein, a mixed MTPOM material having higher molecular weights than methylal, provides benefits not available with methylal alone. The fuel containing the mixed MTPOM blend component is safer to handle and use than fuel containing the same amount of methylal. It has also been found that the properties of mixed MTPOM diesel fuel relative to fuel containing methylal alone as a blended component indicate that the MTPOM fuel is less volatile, has a higher flash point, has a higher viscosity closer to that of conventional diesel fuels and, importantly, has higher fuel lubricity. The measured properties of a Phillips low-sulfur DF-2 diesel fuel, methylal, MTPOM, and blends of about 85% DF-2 diesel fuel with about 15%, by volume, methylal and with about 15%, by volume, MTPOM, are shown in table 1 below.

TABLE 1

| FUEL | VISCOSITY @ 40° C., cSt | IGNITION DELAY, ms @ 1000° F., 530 psig | PREDICTED CETANE NO. | BOCLE wear scar Dia. (mm) | SMOKE POINT (mm) |
|---|---|---|---|---|---|
| DF-2 | 2.78 | 2.74 | 39.8 | 0.608 | 16.0 |
| METHYLAL | 0.32 | 2.45 | 47.0 | — | — |
| MTPOM | 0.62 | 5.97 | 16.0 | — | — |
| DF-2/ METHYLAL | 1.34 | 2.83 | 38.0 | 0.565 | 16.5 |
| DF-2/ MTPOM | 1.69 | 2.87 | 37.3 | 0.504 | 16.2 |

A Constant Volume Combustion Apparatus (CVCA) was used to measure the ignition characteristics of methylal, MTPOM, and the DF-2methylal and DF-2MTPOM blends at an air temperature of 1080° F. and a pressure of 530 psia. These conditions of temperature and pressure are comparable with those in diesel engines. The ignition delay in milliseconds and the predicted cetane number based upon the ignition delay time are listed above. The results show that methylal and MTPOM have a negligible effect on the cetane rating of the DF-2-based fuel. In light of the fact that the DF-2 MTPOM blend was found to have a cetane number very near that of the DF-2 base fuel, indicates that the more ignitable molecules in the MTPOM product tend to preferentially dissolve in the DF-2.

Fuel lubricity is especially important in the operation of diesel engines because of the small clearances, fine tolerances, and the wear characteristics of high pressure fuel pumps and injectors. Lubricity measurements were performed by the ASTM D 5001 method using a ball-on-cylinder lubrication evaluator (BOCLE). The measurements presented above in Table 1 were conducted in duplicate, and the wear scar diameters were found to be consistent within 0.01 mm. The results listed in the above table show that the DF-2 methylal blend exhibit at a greater lubricity than the base fuel. Importantly, however, this benefit was even greater with DF-2 MTPOM blended blend.

Smoke points were measured by the ASTM D 1322 method. Smoke point is measured in terms of the height of a diffusion flame where the smoke trail disappears; as the height increases, the sooting tendency of the fuel decreases. Significantly, the addition of MTPOM to the DF-2 diesel fuel had no significant effect on the smoke point value.

Thus it can be seen that an improved diesel fuel produced in accordance with the method described above provides a low-sulfur fuel having dramatically improved lubrication qualities without sacrifice of autoignition and smoke generation characteristics. Fuel lubricity could become a significant problem in the low-sulfur, low-aromatics diesel fuels that will be required to meet future emissions requirements. Low fuel lubricity causes excessive wear of injectors and other fuel-wetted parts in the system.

Although the present invention is described in terms of a preferred exemplary embodiment, with specific illustrative methods for producing a mixed methoxy-terminated poly-oxymethylene and diesel blend with diesel fuel, those skilled in the art will recognize that other methods, and in particular continuous processes for larger volume production, may be used to form the mixed methoxy-terminated poly-oxymethylene. Also, other alkoxy- groups may be used to terminate the poly-oxymethylene polymer by making a suitable choice of reactants, for example, the subsitution of ethanol for methanol in the reaction with paraformaldehyde would yield ethoxy-terminated poly-oxymethylenes. Also, continuous processing techniques may be used to mix the alkoxy-terminated poly-oxymethylenes with the base diesel fuel and for the subsequent separation, such as by centrifugal separation , of the two phases. Such changes are intended to fall within the scope of the following claims. Other aspects, features, and advantages of the present invention may be obtained from a study of this disclosure, along with the appended claims.

What is claimed is:

1. A method for forming an improved diesel fuel comprising:

providing a mixture of alkoxy-terminated poly-oxymethylenes having a molecular weight of from about 80 to about 350;

mixing said mixture of alkoxy-terminated poly-oxymethylenes with diesel fuel in a ratio, by volume, of 1 part mixed alkoxy-terminated poly- oxymethylenes with from about 2 to about 5 parts diesel fuel; and separating said mixed alkoxy-terminated poly-oxymthylenes and diesel fuel into a first phase containing diesel fuel and said mixed alkbxy-terminated poly-oxymethylenes, and a second phase containing insoluble reaction products from the synthesis of said mixed alkoxy-terminated poly-oxymethylenes and gums extracted from said diesel fuel.

2. A method for forming an improved diesel fuel, as set forth in claim 1, wherein said providing a mixture of alkoxy-terminated poly-oxymethylenes includes reacting about 1 part methanol with about 3 parts paraformaldehyde in a closed system for from about 4 to about 6 hours at a temperature of from about 150° C. to about 240° C. and at a pressure of from about 300 psig to about 1000 psig.

3. A method for forming an improved diesel fuel, as set forth in claim 1, wherein said providing a mixture of alkxy-terminated poly-oxymethylenes includes reacting about 1 part methylal with about 5 parts paraformaldehyde and about 0.1% by weight formic acid in a closed system for from about 4 to about 7 hours at a temperature of from about 150° C. to about 240° C. and at a pressure of from about 300 psig to about 1000 psig.

4. A method for forming an improved diesel fuel, as set forth in claim 1, wherein said separating said mixed alkoxy-terminated poly-oxymethylenes and diesel fuel into first and second phases includes gravity separation to form separate first and second phases and subsequent decantation of said first phase from said second phase.

5. A method for forming an improved diesel fuel, as set forth in claim 1, wherein said mixing said mixture of alkoxy-terminated poly-oxymethylenes with diesel fuel includes mixing about 1 part by volume mixed alkoxy-terminated poly-oxymethylenes to about 3 parts by volume diesel fuel.

6. A method for forming an improved diesel fuel, as set forth in claim 1, wherein the first separated phase comprises about 80% of said mixed alkoxy-terminated poly-oxymethylenes and diesel fuel mixture prior to separation into two phases.

7. A fuel for compression ignition engines comprising from about 70% to about 95% diesel fuel and from about 5% to about 30% of mixed alkoxy-terminated poly-oxymethylenes.

8. A fuel for compression ignition engines, as set forth in claim 7, wherein said mixed alkoxy-terminated poly-oxymethylenes have a molecular weight of from about 80 to about 350.

9. A fuel for compression ignition engines, as set forth in claim 7, wherein said fuel has a lubricity property, as indicated by the diameter of a wear scar measured by methods set forth ASTM D 5001 using a ball-on-cylinder lubrication evaluator, of less than 0.55 mm.

* * * * *